US005328040A

United States Patent [19]

Morrow

[11] Patent Number: 5,328,040

[45] Date of Patent: Jul. 12, 1994

[54] THRUST-CENTERING CRANE AND METHOD

[76] Inventor: William D. Morrow, 16350 Park Ten Pl., Ste. 202, Houston, Tex. 77084

[21] Appl. No.: 995,956

[22] Filed: Dec. 23, 1992

Related U.S. Application Data

[63] Continuation of Ser. No. 676,090, Mar. 27, 1991, abandoned.

[51] Int. Cl.[5] ..... B06C 23/84

[52] U.S. Cl. ..... 212/253; 212/190; 384/591

[58] Field of Search ..... 212/253, 190; 384/591, 384/592, 593, 590

[56] References Cited

U.S. PATENT DOCUMENTS

| | | | |
|---|---|---|---|
| 226,996 | 4/1880 | Greenleaf | 384/591 |
| 1,079,911 | 11/1913 | Cuenot | 384/591 |
| 1,276,530 | 8/1918 | Hovey et al. | 384/591 |
| 1,348,008 | 7/1920 | Insley et al. | 212/253 |
| 3,160,284 | 12/1964 | Moore | 212/156 |
| 4,061,230 | 12/1977 | Goss et al. | 212/179 |
| 4,184,600 | 1/1980 | Goss et al. | 212/175 |
| 4,216,870 | 8/1980 | Bonneson et al. | 212/253 |
| 4,513,869 | 4/1985 | Goudy | 212/175 |

FOREIGN PATENT DOCUMENTS

| | | | |
|---|---|---|---|
| 10730 | of 1894 | United Kingdom | 212/253 |
| 2177374 | 1/1987 | United Kingdom | 212/253 |

*Primary Examiner*—Michael S. Huppert
*Assistant Examiner*—Thomas J. Brahan
*Attorney, Agent, or Firm*—Kenneth A. Keeling

[57] ABSTRACT

A crane design which permits limited rotation in the plane of loading of the upperworks of a pedestal crane independently of the central support thereof, and independently of the thrust and radial bearings about an extension of such central support. Means for centering the vertical loading vector and horizontal overturning moments by restricting the possible displacements thereof are disclosed, as are methods for accomplishing the same.

15 Claims, 4 Drawing Sheets

THRUST-CENTERING CRANE AND METHOD

RELATED APPLICATIONS

This is a continuation of copending application Ser. No. 07/676,090 filed on Mar. 27, 1991, now abandoned.

This invention relates to co-pending application Ser. No. 07/667,196 filed Mar. 11, 1991 entitled Self-Compensating Crane And Method. While dramatic benefits will result from the employment of the principles of this invention alone, still greater benefits will be obtained if used in combination with those of the aforesaid companion invention.

BACKGROUND OF THE INVENTION

This invention relates to a novel type of crane useful in many different environments but having particular usefullness in offshore applications. It overcomes problems which have long vexed the operators of offshore production facilities and marine drilling rigs of all types.

Offshore platforms need cranes to rapidly and safely load and off-load various material and personnel from floating vessels in the open sea to and from the fixed structures. The primary loads imposed upon such cranes are essentially of two types, a vertical load and an overturning moment. The vertical load in turn may be considered to consist primarily of two components, the dead weight of the crane structure itself and the actual load being lifted under dynamic conditions. It is to be realized that such conditions can be extremely dynamic, as, for example, when a vessel suddenly drops from the top of a wave to the bottom of a trough without adequate slack in the lines to compensate for such a rapid displacement. The dynamic loading of such cranes under such conditions can be, and often is, quite severe. The overturning moment is essentially the product of the dynamic load and the distance from the load to the centerline of rotation of the crane. This overturning moment is often applied impulsively.

Dockside cranes have long encountered similar conditions. The engineers of the eighteenth and nineteenth centuries attempted to resolve these problems by separating a pair of bearings or pivot points as widely as possible from each other. Perhaps because of the long-standing tradition with masts and riggings of sailing vessels, these early engineers separated these bearings vertically and resolved the overturning moment by a permanently mounted foundation fixed to the earth.

It eventually was realized that the utilization of these early cranes and derricks could be increased were they movable from place to place. The desire for such mobility presented two primary requirements which may be fairly said to have led directly to the configuration of the modern construction cranes which have been adapted for use in the off-shore petroleum industry.

The first requirement for mobility was that such cranes could no longer be permanently attached to a foundation fixed to the earth. This in turn directly led to the use of counterweights to create an approximately equal but opposite overturning moment or couple to that created by the load, thus essentially reducing the loading on such mobile cranes to a vertical load on the wheels or tracks—in essence a balancing operation. It was soon realized that the actual weight or mass of the counterweight could be significantly reduced by causing it to rotate with the crane, thereby keeping it in the most advantageous position with respect to the load. It was also soon realized that the weight of the crane boom itself and any portion off the crane structure on the load side of the centerline of rotation significantly reduced the lifting capability of such cranes, thus spurring considerable effort to develop light weight and highly stressed boom structures, often of exotic materials.

The second requirement for mobility was a limitation on height to clear overhead obstructions, which precluded the use of a pair of vertically separated bearing assemblies. It then became necessary to resist the overturning moment by horizontally spaced bearings situated close together. Because such cranes typically must be capable of revolving 360°, such bearing arrangements typically took the form of a circle. The two methods in use today for this purpose are known as Hook Rollers and Ball Rings, with the latter sometimes being referred to also as Slewing Rings.

When offshore oil exploration beyond the sight of land was first accomplished around 1947, the only cranes available were construction cranes which had evolved as outlined above. These cranes had many shortcomings when removed from their intended application and transferred to offshore platforms to transfer material and personnel from floating vessels in the open sea. The balancing condition—or, more precisely, the impending loss of balance—could no longer satisfactorily be used to warn of impending overload situations when loading from a heaving vessel, a condition which frequently resulted in cranes being toppled into the ocean.

Mere removal of the undercarriage and permanent attachment of the rotating superstructure to the platform were only marginal improvements at best since impending unbalance could no longer be used as a 'safety valve' when loading such cranes offshore. Designers necessarily had to strengthen such designs considerably in order for such cranes to have any chance at all of performing their intended functions, and the resulting cranes were extremely heavy, expensive and still unsatisfactory in operations.

A very few designers decided to design cranes specifically for the offshore industry and to be affixed permanently to offshore platforms. Since such cranes had no need for mobility, low height was no longer a requirement, and vertically separated bearing assemblies could again be employed. The affixable, pedestal-type crane with center post (or 'king' post) removed both the requirement for counterweights and the impetus for light weight, exotic boom structures since such cranes were intended only for fixed mounting.

The pedestal-type, center post, affixable crane was a considerable improvement over the "ball ring" or "slewing ring" cranes, which generally require removal of the entire crane rotating structure from the slew ring and platform in order for the bearing to be replaced. Addtionally, such designs generally combined the bearing function and structural function into a single mechanical assembly—functions which have incompatible if not mutually exclusive characteristics in that bearings need very hard materials which are inherently brittle while structural members need ductile characteristics in order to withstand the repeated shock loadings to which offshore cranes are subjected. The king post design, on the other hand, allows replacement of the swing bearings without the use of another crane, and thus was seen as a significant advance in the state of the art.

Despite its many advantages, and despite the greater design freedom permitted by separation of the bearing and structural functions, the bearings of the king post designs continued to pose problems. U.S. Pat. No. 4,061,230, for which applicant was a co-inventor, discloses a plurality of roller assemblies attached to the rotating superstructure of the crane and disposed about the king post. Each such roller assembly comprises a pair of small diameter, horizontal rollers pivotable about an apex displaced from the central post in order to permit the roller assemblies to adapt to irregularities in the central or king post. However, this reference does not contemplate nor teach a unitary structure or method for permitting ease of access to such bearings for inspection or removal. While this design and similar designs are in frequent use, they surfer from a number or disadvantages. Unless such rollers are of extremely small diameter in comparison to the center post, they will require a good bit of space, and if they are comparatively small, the rollers will frequently slide on the king post rather than rotate about their axles. This condition becomes even more pronounced when any grease or oil accumulates on either the rollers or their track around the post, which in turn may cause 'flat spots' to wear on the rollers or cause the rollers to cut a groove in the post. The latter problem is frequently evident when the rollers are made of a material harder than that of the king post. Such a groove can lead to structural failure in the king post without warning, with the crane assembly falling from its mounting. Also, replacement of the rollers and/or roller assemblies is normally quite difficult because of the extremely tight space containing the same.

Attempts to overcome these problems directly led to a third generation of modern crane design. These designs generally affixed a removable wear strip to the center post and a mating ring to the rotating superstructure which slides on the stationary wear strip as the superstructure revolves about the king post. This concept is exemplified by U.S. Pat. No. 4,184,600 to applicant and another. While overcoming the problems of the multiple roller design and experiencing considerable commercial success, such designs are not themselves without disadvantages. The wear strips must of necessity be installed on the center posts before the superstructures are mounted, and the clearances therebetween must necessarily be quite small. Since such superstructures may be quite large and heavy objects, it is not always easy to maneuver them into place with the degree of precision required, particularly if the lifting crane is on a vessel. These factors result all too often in damage to or even destruction of the wear strips during installation of the superstructure over the king post. Additionally, such wear strips are quite difficult to install properly. Ordinarily the wear strips will not fit absolutely tightly around the center post, which can result in a bulge or wave in the strips as the crane is revolved. This in turn leads to premature failure of the wear strip fasteners, thus allowing the strips to slide about and be destroyed in short order.

Still another disadvantage off such a bearing design arises from the inevitable misalignment between the axis of rotation of the superstructure under load and the vertical axis of the center post. Although quite small, this angular misalignment causes the lower edge of the mating ring affixed to the rotating superstructure to tend to cut the stationary wear strip. While such bearings may be replaced with considerably less difficulty than those of previous designs, it is nevertheless a not insignificant inconvenience and expense to have to replace such bearings prematurely.

Attempts to overcome these disadvantageous features in turn led to the fourth generation of modern pedestal-type cranes as exemplified by U.S. Pat. No. 4,354,606 to applicant and another. This design utilizes removeable semicircular shoes mounted within the rotating superstructure to which the wear strips are then affixed. Since the wear strips need not be affixed prior to mounting the superstructure, and since the superstructure need only be centered about the center post as taught in U.S. Pat. No. 4,184,600 and not elevated as required by the '600 design, the damage or destruction to the wear strip during installation is eliminated. However, this design is also subject to angular misalignment between center post and superstructure, which causes extremely high point or line loading of the wear strips. This tendency toward point loading is exacerbated by the necessary difference between the inside diameter of the shoes with wear strips attached and the outside diameter of the center post, resulting in only a very small portion or the wear strips actually being in contact with the pedestal when under load, which in turn results in a relatively low load carrying capability for the shoes.

Owing to the "point" or "line" nature of the loading, the load carrying capability cannot be increased simply by the expedient of enlarging the bearing surface area: only a small fraction of the existing bearing surface area is actually utilizeable, and increasing the surface area of such bearings would only increase the amount of unused bearing area, and would not increase the load carrying capability at all. To increase the actual load carrying capability of such cranes, their designers greatly increased the separation between the upper and lower horizontal bearings. This in turn results in cranes which are 'over tall' in relation to their moment-resisting ability and which are somewhat overweight when compared to similar capacity cranes of other designs. Heretofore, these height and weight penalties were not critical, but with growing concern about helicopter safety—and increasing regulations limiting approach angles to helipads—the allowable heights of platform equipment such as cranes are becoming more limited. Additionally, the increased quality controls placed on the industry have combined with the increasing price of steel to cause the costs of fabricated steel weldments such as center posts and rotating superstructures to increase radically in recent years.

Thus for safety reasons the industry is in urgent need of an improved crane design which can transmit larger actual bearing loads with a significantly reduced overall height and which can operate in the offshore environment without potentially catastrophic defects building up latently. In addition there is a pressing economical need for an improved design that will reduce the initial capital cost required and which can extend the intervals between bearing replacements with their associated high downtime costs.

SUMMARY OF THE INVENTION

All center post crane designs known to applicant inevitably and inherently incorporate both an angular misalignment and a translational displacement between the longitudinal axis of the center post and the actual axis of rotation of the superstructure when under load. Stated otherwise, the thrust vector representing the overall load imposed upon the center support from the combined load of the weight of the crane itself and the external load upon such crane is never truly vertical and perfectly centered but is always displaced translationally a significant distance from the centerline of said central support. In many instances, this displacement is on the order of feet rather than a mere inch or so. A direct consequence of this rotational and translational displacement of the thrust vector is severe point or line loading of the thrust bearing, which reduces the actual lifting capability of such cranes to a fraction of their theoretical capability and which causes rapid, uneven wear. Another direct consequence is a displacement of the horizontal or radial load vectors, from a plane normal to the centerline of such central support to the vertical extremes of the corresponding interacting support surfaces, which also causes point or line loading of the radial bearings with concomitant undesireable consequences. In an ideal embodiment of the present invention, the translational displacement of such overall thrust vector is significantly limited and is constrained to the near vicinity of a plane containing the centerline of such central support. While the magnitude of this somewhat off-vertical load will not be diminished, its moment arm will be radically diminished, perhaps as much as 90% or more. Since this greatly reduces the line loading upon and the compression of the thrust bearing, the angular displacement of this thrust vector may also be reduced somewhat, though not as dramatically as the reduction of the moment arm. The end result is a crane which minimizes the overturning moment imposed upon the crane by any given load, which greatly increases the lifting capacity of any given size crane, which greatly increases the safety factor for any given load, and which significantly decreases the post height in comparison to that of prior art cranes. In addition, an ideal embodiment would also utilize the principles of my aforesaid co-pending application to achieve as near optimum a design as the present state of materials science will allow.

DESCRIPTION OF THE PREFERRED EMBODIMENT

It is to be understood that the principles of this invention have applicability to a wide variety of crane designs and to a wide variety of applications beyond the off-shore petroleum industry. It is also to be understood that, once the principles of this invention have been learned, they may be implemented in diverse forms of apparatus and/or methods. The design is particularly suitable for fabrication of major components from conventional steel, although high strength steels or other suitable high strength materials may be used if desired.

Figures 1, 7, 8:
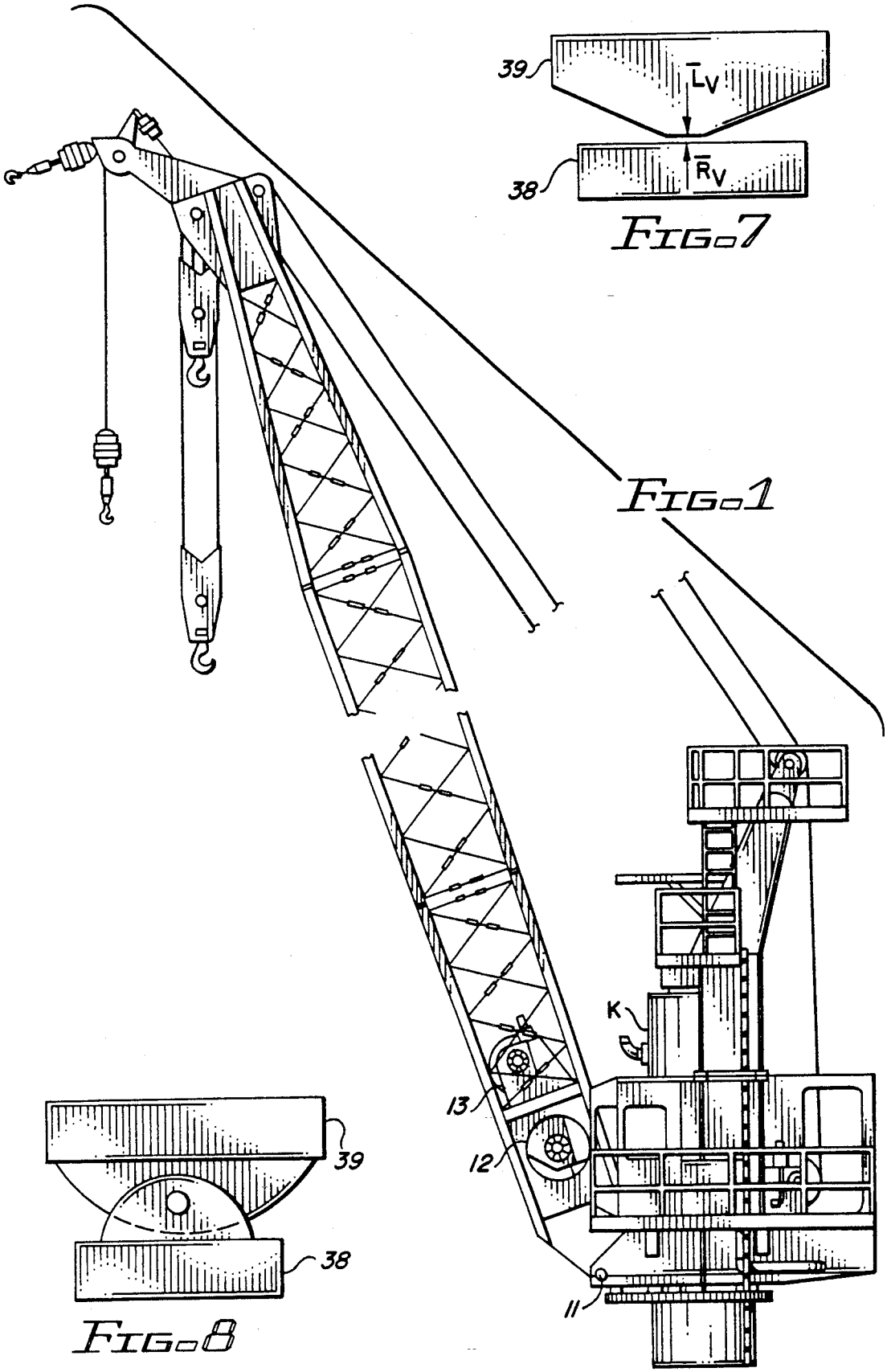
FIG. 1 is an elevational view of a pedestal crane showing a pedestal crane assembly surmounting a pedestal.
FIGS. 7 and 8 are elevational views of alternate embodiments of a portion of the structure of FIG. 4.

As shown in FIG. 1, the crane assembly C includes a boom designated generally as 10 which is affixed to the super-structure designated generally as 20 and with respect to which the boom 10 is free to rotate about a horizontal axis 11. The king post K may be rigidly mounted to any desired supporting structure (not shown) such as a pedestal of an off-shore platform, a moveable vehicular frame, a permanent foundation embedded in the earth, or any other such structure. In a crane of this design, the superstructure 20 depends from the gantry weldment 30 which is free to revolve, ideally horizontally, about the king post K. Preferably, main hoist 12 and auxiliary hoist 13 are disposed within boom 10 as taught in the prior art. Such a configuration will provide a stable geometry for the crane under load since the position of the load will not change with respect to the boom as boom 10 is raised or lowered by boom hoist 14.

Figure 2:
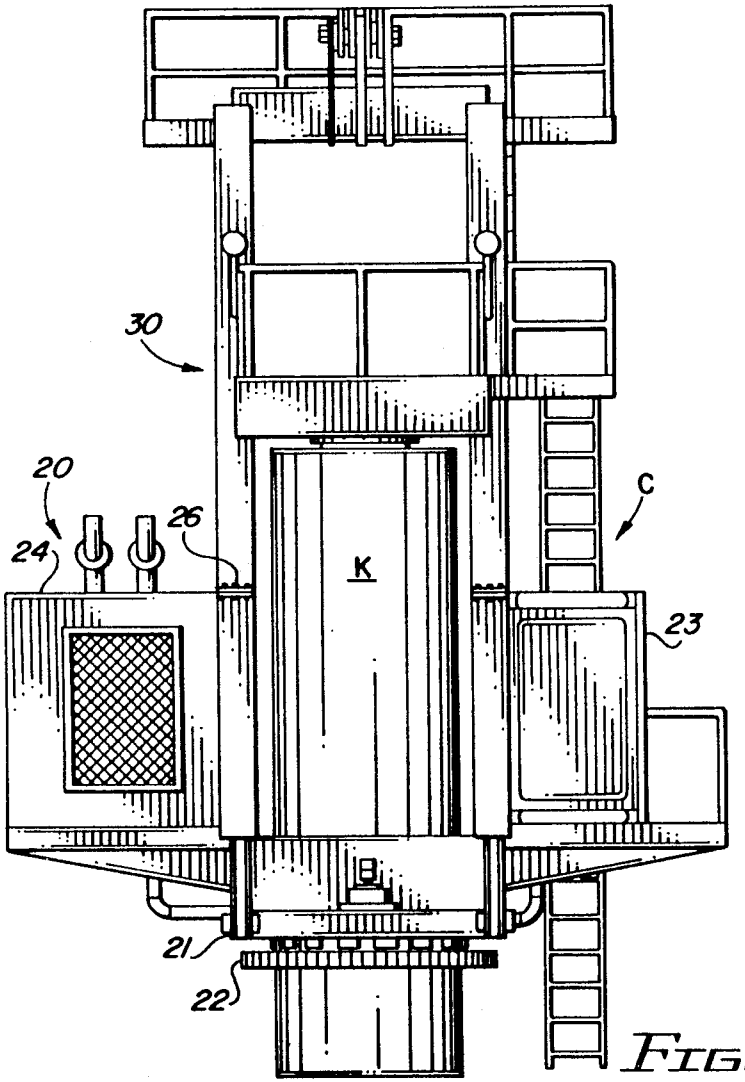
FIG. 2 is a frontal view of the structure of FIG. 1 with the boom assembly removed for clarity.

FIG. 2 shows an enlarged frontal view of the structure of FIG. 1 with boom assembly 10 removed, i.e., as would be seen from the boom assembly 10. The operator's enclosure 23 and controls are preferably situated to one side of king post K and the motive power 24 to the other side. As indicated in my co-pending application, the assembled components including superstructure and gantry which are supported by and revolvable around the central support are generally referred to as the upperworks.

Figure 3:
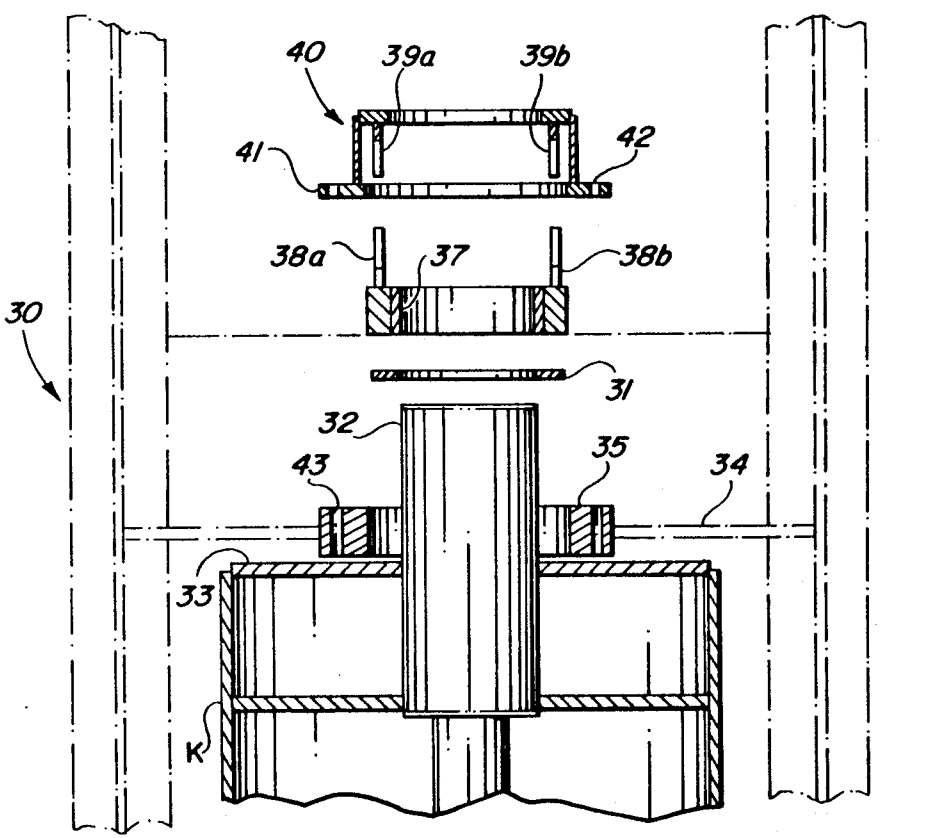
FIG. 3 is an exploded, enlarged view in cross-section of a portion of the structure of FIG. 2.
Figure 5:
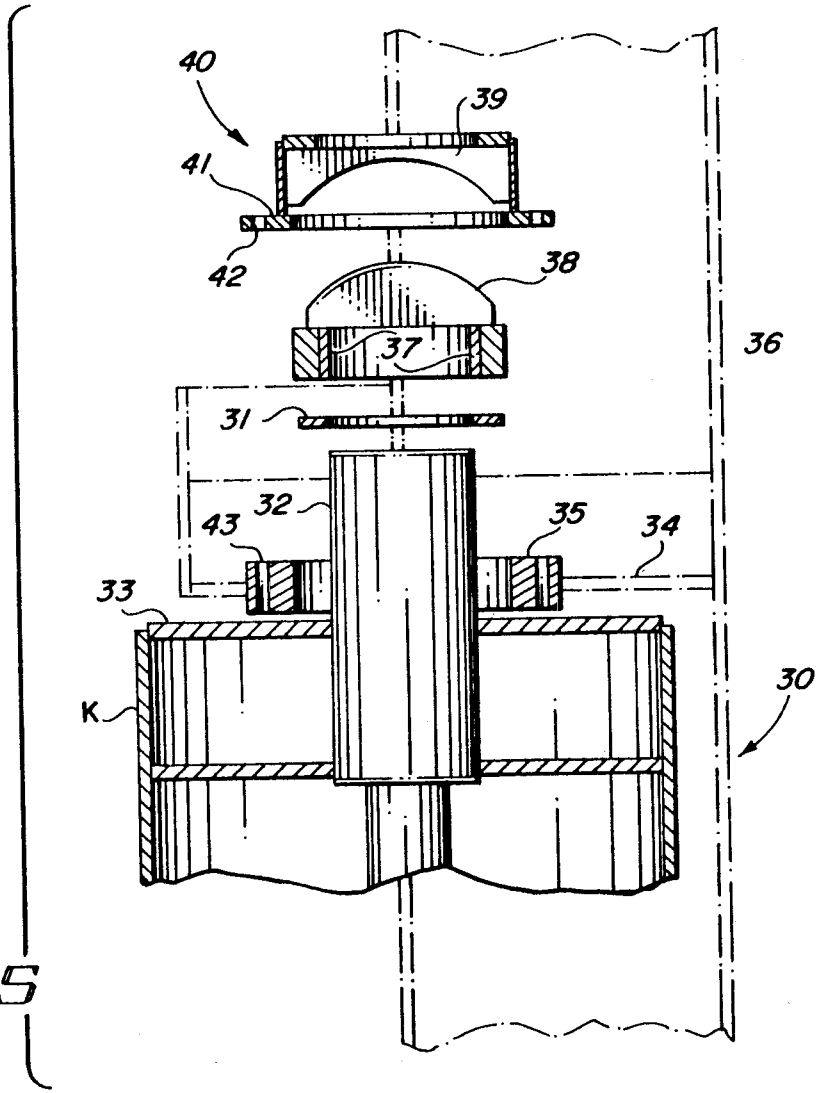
FIG. 5 is a true side view of the structure of FIG. 3.
Figure 4:
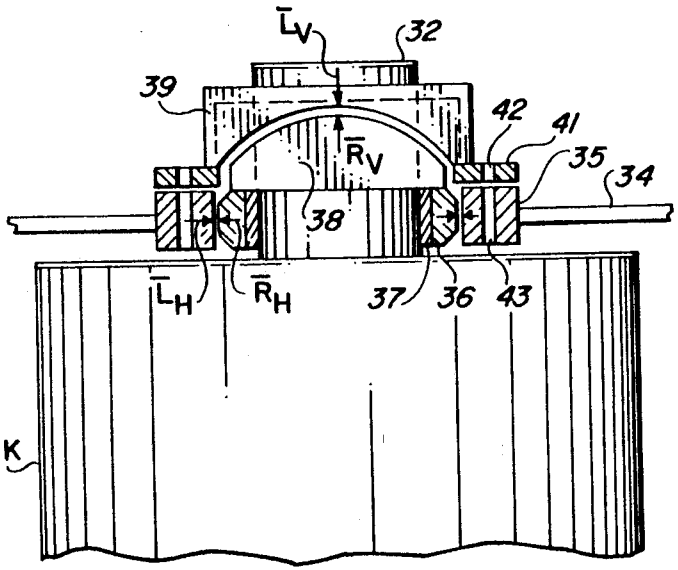
FIG. 4 is a functionally illustrative, partially schematic side view of the structure of FIG. 3.
Figure 6:
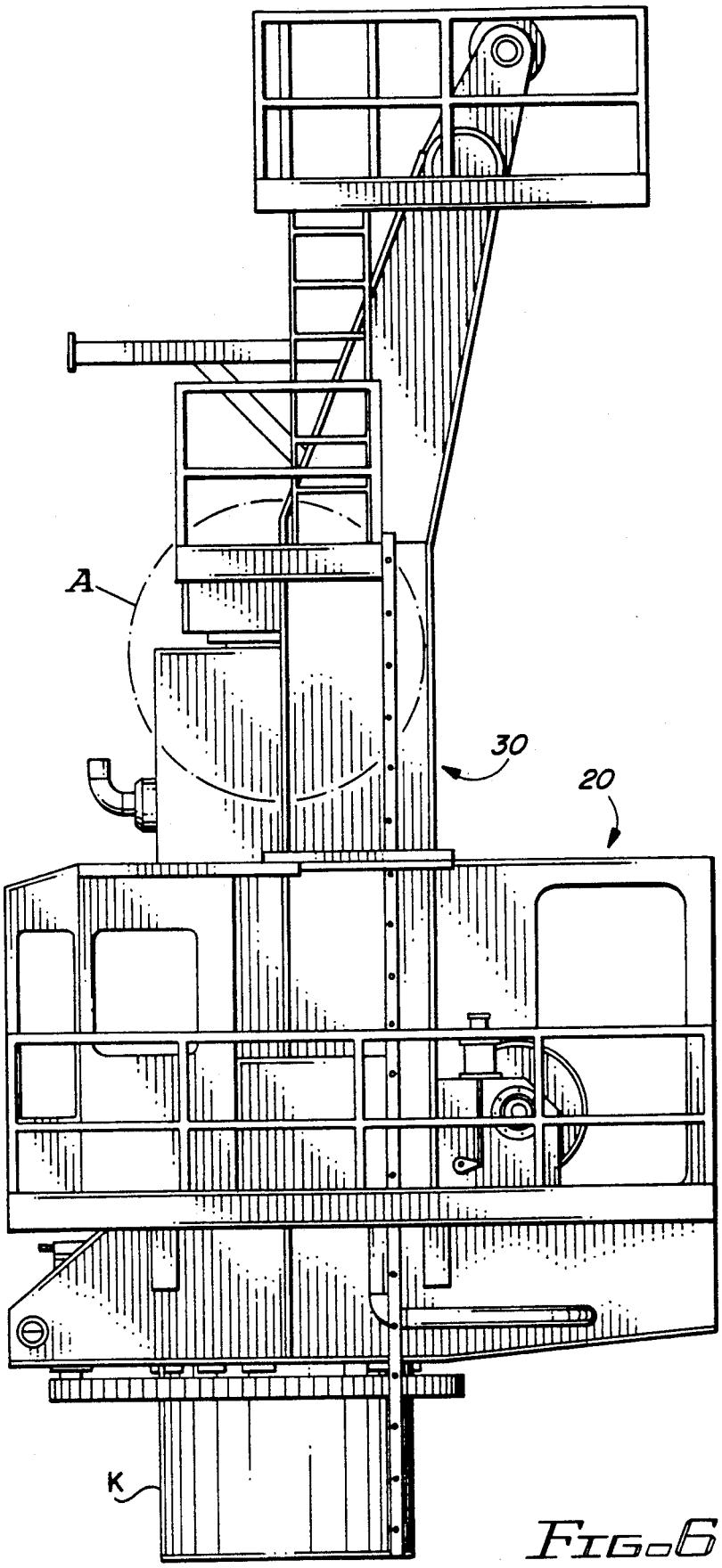
FIG. 6 is a side view of the structure of FIG. 2; the encircled area depicts that portion of the structure shown enlarged in FIGS. 3, 4 and 5.

FIG. 3 is an exploded, enlarged view in cross-section of that portion of FIG. 6 denoted by the circle A, viewed in the same direction as FIG. 2. FIG. 4 is a side view, in partial schematic, of the structure of FIG. 3 with some parts omitted and with co-acting parts shown artificially separated for clarity. When assembled, thrust bearing 31 surrounds the stationary center pin 32 intermediate king post top plate 33 (also stationary) and revolvable gantry cross-structure 34 and affixed bearing retainer 35; bearing carrier 36 and associated radial bearing 37 surround said center pin 32 inside receptacle 35. FIG. 5 is a true side view of the structure of FIG. 3.

While the principles of the present invention may be used in many different means of limiting the locations at which the overall thrust loading $\overline{L}_v$ may be imposed, it has been found preferable to employ that as shown in FIGS. 3 and 4. Such a design is tolerant of imperfections of the degree normally present in flame cutting and does not require precisely machined parts with the attendant expense. Rather, it is entirely suitable to attach a pair of spaced-apart alignment plates 38*a* and 38*b* to bearing carrier 36 of the configuration shown more clearly in profile in FIG. 4. These alignment plates may be more fully described as thrust-receiving alignment plates 38*a* and 38*b* to distinguish them from the thrust-imposing alignment plates 39*a* and 39*b* of revolving upper bearing cap weldment 40.

The base plate 41 of upper bearing cap weldment 40 contains a plurality of bolt holes 42 which align with a plurality of similar holes 43 in revolving bearing retainer 35 of gantry weldment 30, and which may be connected thereto by a plurality of bolts (not shown) therethrough. When loaded, the summation of all vertical forces from gantry weldment 30 will be passed in tension through the plurality of bolts through retainer 35 and base plate 41 to thrust-imposing alignment plates 39*a* and 39*b*. This loading will in turn be imposed upon thrust-receiving alignment plates 38*a* and 38*b*, through the thrust bearing 31 to king post top plate 33. Were the upper plates 39 and the lower plates 38 to have the same radii of curvature—or, equivalently, were their interfaces to be parallel flat plates analogous to the prior art—the point of loading the summed near-vertical loads $\overline{L}_v$ could be displaced the full extent of their interfaces. Stated otherwise, the point of application of the vector $\overline{L}_v$ could be—and in the prior art is—displaced from the center of the central support out to a point directly above that portion of thrust bearing 31 in line with the load being lifted by boom 10. However, by forming lower plates 38 of smaller radii than upper plates 39, the superimposed load $\overline{L}_v$ may be constrained to a point a mere inch or so removed from the plane of the centerline of the central support.

The greater the difference in radii, the smaller will be the displacement travel of superimposed load $\overline{L}_v$. However, materials limitations impose limits upon how narrowly such displacement may be constrained. In actual use, in most situations, the point of application of vector $\overline{L}_v$ will move back and forth along thrust-centering plates 38 and 39, from a plane containing the centerline of central support K and center pin 32 and perpendicular to boom 10, towards the boom and away from the boom as loads are placed upon and removed from the crane. Equal and opposite reactive load vector $\overline{R}_v$ will of course translate along with load vector $\overline{L}_v$. It should be understood that, while the arcuate forms of such thrust centering surfaces have been determined preferable, other forms may also prove satisfactory. Such surfaces could, for example, be comprised of a series of chords, of equal or unequal lengths; the general concave-convex relationship of the thrust-imposing and thrust-receiving members could be reversed; the thrust-imposing member could take the form of a modified "V"; and any number of other arrangements could be provided, so long as the area of the actual interface therebetween is adequately sized so that the stresses imposed do not exceed the limitations of the materials being employed.

Prior art arrangements generally had an effectively rigid connection between the thrust-imposing and thrust-receiving members, with the result that, as the upperworks tilted in the direction of the boom under load, the radial bearing structure arid radial bearing were forced to tilt along with the upperworks, thereby inducing-point or line loading on both the radial bearing and the thrust bearing beneath the radial bearing structure. By eliminating the effectively rigid connection and permitting the thrust-imposing portion of FIGS. 3,4 and 5 (thrust-imposing plates 39*a*,*b*; upper bearing cap weldment 40; revolving gantry cross-structure 34 and gantry weldment 30) to tilt about the thrust-receiving structure (plates 38*a*,*b*; bearing carrier 36 and radial bearing 37) while constraining the permitted displacement of the point of application of imposed load vector $\overline{L}_v$, the moment-arm of such load vector is reduced from feet to a mere inch or so.

The same principle may be employed for radial bearing 37 to similarly constrain the displacement of the relatively horizontal loading vector $\overline{L}_H$. FIG. 4 is a partially schematic view of arid at a right angle to the structure of FIG. 3. The plane of the paper, in FIG. 4, is generally the plane in which the aforementioned "tilt" occurs. If the interfaces of bearing carrier 36 and of bearing retainer 35 are arranged so as to similarly constrain the permitted displacement of the point of application of loading vector $\overline{L}_H$, similar beneficial results will ensue. The horizontal loading vectors and reactive loading vectors are shown in FIG. 4 displaced to the maximum extent permitted by the arrangement shown. As stated above, any number of such arrangements could be provided, but the chordal arrangement as shown in FIG. 4 has been found quite satisfactory. That portion of bearing carrier 36 which actually interfaces with bearing retainer 35 in the plane of 'tilt' may conveniently take the form of illustrated chords, which may be of equal or unequal length. The interface of bearing retainer 35 may be left vertical in cross-section, or such interface could be modified and that of carrier 36 left unaltered, or both could be shaped however as may be desired, with the limiting factor again being the tolerable stress level of the materials employed. Whereas the prior art permitted the imposed load $L_H$ to be displaced to an extremity of retainer 35, the principle of this invention will constrain its permitted displacement to very near the center of such retainer, similarly reducing the moment-arm of the loading and eliminating point or line loading upon the radial bearing.

With elimination or virtual elimination of line loading upon both radial and thrust bearings, bearing loading approaching the theoretical capability of bearing materials may be realized under 'real-world' conditions, with the dramatic benefits recounted hereinabove.

It should be apparent that it is within the concept of the present invention to employ means either for centering the thrust loading or the horizontal loading, or both. It should also be apparent that most benefit will be derived from employing such means for both purposes. Those skilled in the art will realize that the principles herein could be applied equally well to cranes of inverted king post design, as well as to a number of other designs. It should be further apparent that maximum benefit will be obtained from using these principles in conjunction with those disclosed in my co-pending application.

Still other alternate forms of the present invention will suggest themselves from a consideration of the apparatus and practices hereinbefore discussed. Accordingly, it should be clearly understood that the apparatus and techniques depicted in the accompanying drawings and described in the foregoing explanations are intended as exemplary embodiments only of the present invention, and not as limitations thereto.

What is claimed as new and desired to be secured by Letters Patent of the United States is:

1. A thrust-centering pedestal-mounted crane, comprising:

support means including a vertical kingpost;

a center pin extending upwardly from said kingpost, said center pin having a lesser circumference than the kingpost circumference;

upper works revolvable around said kingpost;

boom means supported by said upper works;

said upper works including gantry means, said gantry means including gantry vertical members;

cross-structure means fixedly attached to said gantry means;

a bearing retainer attached to said cross-structure means;

a thrust bearing supported on said kingpost;

a bearing carrier, said bearing carrier intermediate said center pin and said bearing retainer;

said bearing carrier supported on said thrust bearing;

a radial bearing intermediate said bearing carrier and said center pin;

first alignment means attached to said bearing carrier;

second alignment means attached to said bearing retainer;

said second alignment means supported on said first alignment means;

the interface of said second alignment means and said first alignment means limited to a predetermined area near the horizontal center of said kingpost; and said bearing retainer, cross-structure means, gantry means and upper works revolvably supported on said kingpost by said second alignment means.

2. A thrust-centering pedestal-mounted crane according to claim 1, said upper works gantry means comprising a pair of horizontally-spaced vertical gantry members exterior of and generally parallel to said kingpost, said vertical gantry members extending a predetermined distance above said kingpost.

3. A thrust-centering pedestal-mounted crane according to claim 2 wherein:

said cross-structure means including a horizontal cross-structure member fixedly attached to said gantry vertical members and to said bearing retainer.

4. A thrust-centering pedestal-mounted crane according to claim 3 wherein:

said first alignment means comprising at least one upwardly-extending convex arcuate plate;

said second alignment means comprising at least one concave arcuate plate;

said at least one convex arcuate plate received within said at least one concave plate;

said at least one convex arcuate plate having a lesser degree of curvature than the said at least one concave plate.

5. A thrust-centering pedestal-mounted crane according to claim 4 wherein:

said first alignment means comprising two spaced upwardly-extending convex arcuate plates;

said second alignment means comprising two spaced concave plates each of said two concave plates aligned with a convex arcuate plate;

each of said two convex arcuate plates received within an aligned concave plate;

each of said two convex arcuate plates having lesser degrees of curvature than said two concave arcuate plates.

6. A thrust-centering pedestal-mounted crane according to claim 4 wherein:

said first alignment means comprising two spaced upwardly-open concave arcuate plates;

said second alignment means comprising two spaced downwardly-extending convex plates each of said two convex plates aligned with a concave arcuate plate;

each of said two convex arcuate plates received within an aligned concave plate;

each of said two convex arcuate plates having lesser degrees of curvature than said two concave arcuate plates.

7. A thrust-centering pedestal-mounted crane according to claim 3 wherein:

said first alignment means comprising two spaced upwardly-extending alignment plates;

said second alignment means comprising two spaced downwardly-extending alignment plates each of said two downwardly-extending alignment plates aligned with an upwardly-extending alignment plate, the engagement of said upwardly-extending alignment plates with said downwardly-extending alignment plates limited to an area near the horizontal center of said kingpost.

8. A thrust-centering pedestal-mounted crane according to claim 3 wherein:

said bearing retainer comprising a hollow, cylindrical member having an inner retainer surface;

said bearing carrier comprising a hollow, cylindrical member having an outer carrier surface;

said bearing carrier concentrically arranged within said bearing retainer;

said inner retainer surface engaging said outer carrier surface at least under load condition of the crane;

the engagement of said inner retainer surface with said outer carrier surface limited to a predetermined vertical range.

9. A thrust-centering pedestal-mounted crane according to claim 8, wherein:

the engagement of said inner retainer surface with said outer carrier surface vertically near to the attachment of the cross-structure member to the bearing retainer.

10. A thrust-centering pedestal-mounted crane according to claim 8 wherein:

said outer carrier surface including an outer carrier surface extension engaging said inner retainer surface, said outer carrier surface having a lesser vertical length than said inner retainer surface vertical length.

11. A thrust-centering pedestal-mounted crane according to claim 8 wherein:

said inner retainer surface including an inner retainer surface extension engaging said outer carrier surface, said inner retainer surface extension having a lesser vertical length than said outer carrier surface.

12. A thrust-centering pedestal-mounted crane, comprising:

support means including a vertical kingpost;

a center pin extending upwardly from said kingpost, said center pin having a lesser circumference than the kingpost circumference;

upper works revolvable around said kingpost;

boom means supported by said upper works;

said upper works including gantry means, said gantry means including gantry vertical members;

a cross-structure member fixedly attached to said gantry vertical members;

a bearing retainer comprising a hollow, cylindrical member having an inner retainer surface attached to said cross-structure member;

a thrust bearing supported on said kingpost;

a bearing carrier comprising a hollow, cylindrical member having an outer carrier surface, said bearing carrier intermediate said center pin and said bearing retainer;

said bearing carrier supported on said thrust bearing;

a radial bearing intermediate said bearing carrier and said center pin;

said bearing carrier concentrically arranged within said bearing retainer;

first alignment means including at least one upwardly-extending convex arcuate plate attached to said bearing carrier;

second alignment means including at least one concave arcuate plate attached to said bearing retainer;

said second alignment means supported on said first alignment means;

said at least one convex arcuate plate received within said at least one concave plate;

said at least one convex arcuate plate having a lesser degree of curvature than the said at least one concave plate;

the interface of said second alignment means and said first alignment means limited to a predetermined area near the horizontal center of said kingpost; and said bearing retainer, cross-structure means, gantry means and upper works revolvably supported on said kingpost by said second alignment means.

13. A thrust-centering pedestal-mounted crane according to claim 12 wherein:

said first alignment means comprising two spaced upwardly-extending convex arcuate plates;

said second alignment means comprising two spaced concave plates each of said two concave plates aligned with a convex arcuate plate;

each of said two convex arcuate plates received within an aligned concave plate;

each of said two convex arcuate plates having lesser degrees of curvature than said two concave arcuate plates.

14. A thrust centering pedestal-mounted crane according to claim 13 wherein:

said inner retainer surface engaging said outer carrier surface at least under load condition of the crane;

the engagement of said inner retainer surface with said outer carrier surface limited to a predetermined vertical range;

said outer carrier surface including an outer carrier surface extension engaging said inner retainer surface, said outer carrier surface having a lesser vertical length than said inner retainer surface vertical length.

15. A thrust-centering pedestal-mounted crane, comprising:

support means including a vertical kingpost;

a center pin extending upwardly from said kingpost, said center pin having a lesser circumference than the kingpost circumference;

upper works revolvable around said kingpost;

boom means supported by said upper works;

said upper works including gantry means, said gantry means including two horizontally-spaced gantry vertical members, exterior of and generally parallel to said kingpost, said gantry vertical members extending a predetermined distance above said kingpost;

a cross-structure member fixedly attached to said gantry vertical members;

a bearing retainer comprising a hollow, cylindrical member having an inner retainer surface, said bearing retainer attached to said cross-structure member;

a thrust bearing supported on said kingpost;

a bearing carrier comprising a hollow, cylindrical member having an outer carrier surface, said bearing carrier intermediate said center pin and said bearing retainer;

said bearing carrier supported on said thrust bearing;

a radial bearing intermediate said bearing carrier and said center pin;

said bearing carrier disposed concentrically within said bearing retainer;

said inner retainer surface engaging said outer carrier surface at least under load condition of the crane;

the engagement of said inner retainer surface with said outer carrier surface limited to a predetermined vertical range;

said outer carrier surface including an outer carrier surface extension engaging said inner retainer surface, said outer carrier surface having a lesser vertical length than said inner retainer surface vertical length;

first alignment means including two upwardly-extending convex arcuate plates attached to said bearing carrier;

second alignment means including two concave arcuate plates attached to said bearing retainer;

said second alignment means supported on said first alignment means, each of said two concave plates aligned with a convex arcuate plate;

each of said two convex arcuate plates received within an aligned concave arcuate plate;

each of said at two convex arcuate plates having a lesser degree of curvature than each of said two concave plates;

the interface of said second alignment means and said first alignment means limited to a predetermined area near the horizontal center of said kingpost;

said bearing retainer, cross-structure means, gantry means and upper works revolvably supported on said kingpost by said second alignment means.

* * * * *